US005676876A

United States Patent [19]

Winkler, III

[11] Patent Number: 5,676,876

[45] Date of Patent: Oct. 14, 1997

[54] FIRE FIGHTING FOAM AND METHOD

[76] Inventor: J. A. Winkler, III, 201 S. Locksley Dr., Lafayette, La. 70508

[21] Appl. No.: 482,413

[22] Filed: Jun. 8, 1995

[51] Int. Cl.[6] ..... A62D 1/00

[52] U.S. Cl. ..... 252/3; 252/8.05

[58] Field of Search ..... 252/3, 8.05

[56] References Cited

U.S. PATENT DOCUMENTS

| | | | |
|---|---|---|---|
| 2,506,062 | 5/1950 | Busse et al. | 252/3 |
| 3,394,768 | 7/1968 | Chocola et al. | 252/2 |
| 3,429,810 | 2/1969 | White | 252/3 |
| 3,929,649 | 12/1975 | Rossmy et al. | 252/3 |
| 4,442,018 | 4/1984 | Rand | 252/307 |
| 4,464,267 | 8/1984 | Chiesa, Jr. et al. | 252/8.05 |
| 4,536,298 | 8/1985 | Kamei et al. | 252/8.05 |
| 4,859,349 | 8/1989 | Clark et al. | 252/3 |
| 4,923,621 | 5/1990 | Greene | 252/2 |
| 5,218,021 | 6/1993 | Clark et al. | 524/26 |
| 5,296,164 | 3/1994 | Thach et al. | 252/307 |

OTHER PUBLICATIONS

Sandia National Laboratories, Release made Dec. 3, 1982.

Dispersion Techniques for Carbopol Polymers, Bulletin DET-5 Revised Mar. 1993.

Neutralization of Carbopol Resins Bulletin DET-6 Revised Feb. 1993.

*Primary Examiner*—C. H. Kelly

*Attorney, Agent, or Firm*—William W. Stagg

[57] ABSTRACT

A method of producing a fire fighting foam for extinguishing fires, which comprises the step of producing a fire fighting foam concentrate solution comprising a short chain linear alcohol as a suspending solvent; lauric alcohol as a foam stabilizing agent; an acrylic acid polymer to form the foam suspension media; sodium lauryl sulfate as a primary foam producing agent; coco-dimethylamidopropyl betaine as a secondary foam producing agent; water as a dilutant; urea as a fire retarding agent; an alkaline pH-modifying substance to adjust the pH of the solution just to the base side of 7.0; and sodium carbonate, sodium bicarbonate, potassium acetate or sodium acetate as a fire retarding agent. A fire fighting foam is produced from the concentrate solution by introducing the foam concentrate solution to a stream of water through a siphoning nozzle.

40 Claims, No Drawings

FIRE FIGHTING FOAM AND METHOD

FIELD OF INVENTION

The present invention generally relates to the field of fire fighting and more particularly relates to a new composition for producing an environmentally and personally safe-to-use fire fighting foam.

BACKGROUND OF INVENTION

In the field of fighting fires, it is often necessary to attempt to control and extinguish fires, including oil, gasoline, diesel fuel and jet fuel fires, by covering the fire with a blanket of foam. In the past, compositions used to produce such foams have had undesirable characteristics which have made them hazardous either to the environment or to the persons using the foam.

The toxic and corrosive nature of the conventional foams may cause harm to the fire fighters, the fire fighting equipment and to the roadways, metals, wood and painted surfaces which come into contact with the foam. Since it is difficult to contain the foams used to combat fires, the conventional foams may cause harm or permanent damage to soils and soil bacteria as well as to land animal and marine life to which it is exposed. Special protective equipment is often required for the fire fighters. Special cleanup, disposal and treatment methods are often required to dean up fire sites after a fire area has been exposed to the conventional and currently used fire extinguishing foams.

Typically, fire fighting or extinguishing foams have in the past included heavy metals, detergents, phosphates, chlorides or fluorides, or butyl carbitol and other caustic, abrasive or reactive chemicals in their makeup.

Such potentially hazardous foams include those described in U.S. Pat. No. 2,506,062 to Warren F. Busse et al which teaches the use of a vinyl ether with maleic anhydride; U.S. Pat. No. 3,929,649 to Rossmy et al which teaches a fire foam comprising a water soluble, surface active organosilicon compound as the active ingredient and U.S. Pat. No. 4,464,267 to Chiesa, Jr. et al which teaches a fire fighting foam concentrate utilizing high concentrations of thixotropic polysaccharide thickener such as heteropolysaccharide-7.

Other potentially hazardous fire fighting foams include those described in U.S. Pat. No. 4,536,298 to Kamei et al and U.S. Pat. Nos. 4,859,349 and 5,218,021 to Clark et al all of which teach the use of fluorides in the compositions.

Consequently, a need exists for improvements in fire fighting foam formulations and techniques to eliminate the aforementioned environmentally harmful components.

SUMMARY OF INVENTION

The invention of the present composition and method is designed to satisfy the aforementioned needs. It provides a water-soluble fire extinguishing foam concentrate comprising an acrylic polymer, foam producing components, a foam stabilizer and fire retardant chemicals which is combined with either fresh or salt water through a siphoning nozzle to produce a fire fighting foam. The foam produced by the composition and method provides fire knockdown and suppression characteristics which are sought after in the fire fighting industry including the characteristics of excellent foam blanket stability, blanket retention time, blanket healing, sealing, clinging as well as excellent suppression of organic chemical vapors.

The composition and method of the present invention provides a fire fighting foam which is environmentally safe, non-hazardous and biodegradable. The foam leaves no residue and will not adversely affect soils and soil bacteria or animal and marine life.

The composition and method of the present invention provides a fire fighting foam which may be utilized with existing fire fighting equipment, such as tanks, hoses, pumps and nozzles, and which will reduce the likelihood of corrosion and equipment damage associated with conventional fire fighting foams.

The composition and method of the present invention provides a fire fighting foam which will not require special protective equipment for its use or special cleanup measures and equipment after the foam is used to extinguish a fire.

The composition and method of the present invention provides a fire fighting foam which contains no heavy metals, phosphates, chlorides or fluorides, and no butyl carbitol.

The composition and method of the present invention provides a fire fighting foam which provides an advantage over conventional and currently used fire foam products. The foam of the present invention requires no special containment or disposal procedures because the foam does not contain components which are regulated for discharge.

The fire fighting foam thus produced will function effectively in both fresh and saltwater so as to provide for its use in a variety of environments.

The foam of the present invention will reduce the cost associated with hazardous waste disposal because the foam itself is non-hazardous, non-corrosive and non-caustic. The foam is free of phosphates, chlorides and fluorides and contains no abrasive or reactive chemicals.

DETAILED DESCRIPTION OF PREFERRED EMBODIMENT

In general, the composition of the present invention is a fire fighting foam concentrate solution comprising the combination of the following components:

(1) A $C_1$–$C_4$ short chain linear alcohol such as n-propyl, CAS 71-36-3, or n-butyl alcohol, CAS 71-23-8, as a suspending solvent;

(2) Lauric alcohol, CAS 112-53-8, as a foam stabilizing agent;

(3) A polymer of acrylic acid (also called an acrylic acid polymer) having a molecular weight in the range of 1,250,000 to 2,500,000 to form the foam suspension media. Such acrylic acid polymers include CARBOPOL C-674, CAS 9003-01-4 and CARBOPOL C-1621 as currently manufactured by B.F. Goodrich.

(4) Either sodium lauryl sulfate, CAS 151-21-3, or an alpha olefin sulfonate, as a primary foam producing agent;

(5) A coco-dimethylamidopropyl betaine, CAS 61789-40-0, as a secondary foam producing agent;

(6) water as a dilutant;

(7) Urea, CAS 77-13-6, as a fire retarding agent;

(8) Either monoethanolamine, CAS 141-43-5, diethanolamine, CAS 111-42-2, or triethanolamine, CAS 102-71-6, to adjust the pH of the solution just to the base side of 7.0; and (9) Either sodium carbonate, CAS 497-19-8; sodium bicarbonate, CAS 144-55-8; sodium acetate, CAS 127-09-3; or potassium acetate, CAS 127-08-2, as a fire retarding agent.

Preferably the components are mixed and stirred at a constant rate in a stainless steel or glass-lined mixing vessel with a three-bladed (marine style) mixer impeller, though other types of vessels and mixing methods may be utilized.

EXAMPLE 1

As an illustrative example, applicant's invention was prepared in the following order of components and in the following quantities. 1.419 kg of n-butyl alcohol, a $C_1$–$C_4$ short chain linear alcohol, was added to a stainless steel mixing vessel as a suspending solvent. 0.285 kg of lauric alcohol was then added to the linear alcohol while the mixture was stirred with a three-bladed, marine style, mixer impeller turning at a rate between 800 rpm and 1200 rpm until all of the lauric alcohol was in solution.

Then, 0.285 kg of B.F. Goodrich CARBOPOL 674, a homopolymer of acrylic acid thought to have a molecular weight of about 1,250,000, was slowly added to the alcohol solution by sifting the acrylic acid polymer through a coarse sieve as a sifting device, into the vortex of the alcohol solution created by the mixer at a rate sufficient to allow the acrylic acid polymer to go into solution as it was added to the mixture. The sieve or screen was required to avoid "lumping" of the acrylic acid polymer and to allow the acrylic acid polymer to be brought into essentially homogeneous solution with the alcohols. It is thought that a No.20 mesh screen would also be a suitable sifting device. The resulting mixture, after addition of the acrylic acid polymer, has the appearance of biscuit dough when the acrylic acid polymer has gone into solution.

Then, while the mixture was continuously stirred, 7.335 kg of a 23% solution of sodium lauryl sulfate and water was added to the mixture until all components were into solution. Then, still under continuous stirring, 14.625 kg of a 35% solution of coco-dimethylamidoproply betaine and water was added to the mixture until all of the components were into solution. Then, still under continuous stirring, 38.697 kg of water was added to the mixture and stirred until the mixture was again homogeneous and all components were into solution.

Next, still with continuous stirring of the mixture, 2.400 kg of granulated urea was added to the mixing vessel until the mixture was again homogeneous and the urea was completely into solution. After the mixture had become homogeneous, and while the mixture was continuously stirred, triethanolamine (99%) was added to the mixture in an amount sufficient to adjust the pH of the mixture to be on the base side of neutrality at or above 7.0. Finally, while the mixture was still continuously stirred, 2.400 kg of granulated sodium bicarbonate (anhydrous, 99%) was added to the mixture until all of the sodium salt was into solution. The pH of the resultant solution was monitored during addition of the carbonate salt to insure that the pH of the solution did not exceed 10 in order to keep the solution homogeneous. The solution resulting from the mixture was a concentrated solution which was used to produce a fire fighting foam when it was introduced to a stream of water through a siphoning nozzle.

Example 1, when combined in the described manner, produces a fire fighting foam concentrate having the following component percentages: 2.10% n-butyl alcohol, 0.42% lauric alcohol, 0.42% of acrylic acid polymer, 10.87% of a 23% solution of sodium lauryl sulfate and water, 21.68% of a 35% solution of coco-dimethylamidoproply betaine and water, 57.37% of water, 3.56% of granulated urea, triethanolamine (99%) in an amount sufficient to adjust the pH of the solution just to the base side of 7.0, and 3.56% of granulated sodium bicarbonate (anyhydrous 99%).

The foam producing solution so created is typically designated by the fire fighting industry as a 3% Fire Fighting Foam Concentrate for fire extinguishing. A fire fighting foam was produced by introducing the fire fighting foam concentrate to a nozzle that could siphon the fire fighting foam concentrate into its water stream at the rate of 3% of the concentrate to 97% water at a nozzle flow rate which was typically 95 to 125 gallons per minute. This foam was sprayed over a range of different fire types, including gasoline fires, diesel oil fires, jet fuel fires and combinations thereof, to determine the characteristics and effectiveness of the foam produced from the concentrate as a fire fighting foam.

Alternatively, the fire fighting foam concentrate may be diluted with an equal volume of water. A fire fighting foam may then be produced which is typically designated in the fire fighting industry as a 6% concentrate by introducing the diluted concentrate to a stream of water produced by a nozzle that can siphon the diluted concentrate at a rate of 6% diluted concentrate to 94% water at a nozzle flow rate typically between 95 and 125 gallons per minute.

EXAMPLE 2

As another illustrative example of the composition of applicants invention, 1.687 kg of an alpha olefin sulfonate and 5.648 kg of water was substituted for the 23% sodium lauryl sulfate, as the primary foam producing agent and 2.400 kg of granulated sodium carbonate (anhydrous, 99%) was substituted for the granulated sodium bicarbonate listed in the above described Example 1.

EXAMPLE 3

As another illustrative example of the composition of applicant's invention, monoethanolamine (99%) was used to adjust the pH of the solution just to the base side of 7.0, rather than the triethanolamine of Example 1.

EXAMPLE 4

As another illustrative example of the composition of applicant's invention, diethanolamine (99%) was used to adjust the pH of the solution just to the base side of 7.0, rather than the triethanolamine of Example 1.

EXAMPLE 5

As another illustrative example of the composition of applicant's invention n-propyl alcohol was substituted for n-butyl as the $C_1$–$C_4$ short chain linear alcohol of Example 1.

EXAMPLE 6

As still another example of the composition of applicant's invention 0.285 kg of CARBOPOL 1621 was used in place of CARBOPOL 674 as the polymer of acrylic acid of Example 1.

EXAMPLE 7

As still another illustrative example of the composition of applicants invention, it is thought that a fire fighting foam concentrate solution having the qualities described herein may be produced when the above enumerated components are combined in the above described manner and in the following range of quantities:

(a) 1.4 kg to 2.0 kg of a $C_1$–$C_1$ short chain linear alcohol such as n-propyl, CAS 71-36-3, or n-butyl alcohol, CAS 71-23-8, as a suspending solvent;

(b) 0.25 kg to 0.4 kg of lauric alcohol, CAS 112-53-8, as a foam stabilizing agent;

(c) 0.25 kg to 0.4 kg of an acrylic acid polymer, such as B.F. Goodrich CARBOPOL 674, CAS 9003-01-4 OR CARBOPOL 1621;

(d) About 7.3 kg of 23% sodium lauryl sulfate, CAS 151-21-3, or 1.7 kg of an alpha olefin sulfonate along with 5.6 kg of water, as a primary foam producing agent;

(e) 7.3 kg to 15.0 kg of 35% coco-dimethylamidopropyl betaine, CAS 61789-40-0, as a secondary foam producing agent;

(f) About 39.0 kg of water as a dilutant;

(g) 0.4 kg to 3.0 kg of granulated urea, CAS 77-13-6, as a fire retarding agent;

(h) Either monoethanolamine (99%), CAS 141-43-5, diethanolamine (99%), CAS 111-42-2, or triethanolamine (99%), CAS 102-71-6, in an amount sufficient to adjust the pH of the solution to more than 7.0; and (i) Either 0.4 kg to 2.0 kg of granulated sodium carbonate, CAS 497-19-8, 0.4 kg to 3.0 kg of granulated sodium bicarbonate, CAS 144-55-8, as a fire retarding agent.

EXAMPLE 8

As still another illustration example of applicant's invention, it is thought that 0.4 kg to 3.0 kg of potassium acetate, CAS 127-08-2 or 0.4 kg to 3.0 kg of sodium acetate, CAS 127-09-3, may be substituted for the sodium bicarbonate or sodium carbonate of Example 7 as the fire retardant.

The fire fighting foam produced from the examples set forth herein may be used on all classes of fires and under most fire conditions. The quantifies utilized in the examples may be changed provided the ratio of the various components to the whole remains the same. It is thought that the foam produced from the concentrates described herein will be safe, fully biodegradable, and not adversely effect soil bacteria, marine life, animals, grass or plants. It is also thought that the fire fighting foam produced from the concentrates described herein will not damage roadways, metal, wood or painted surfaces any more than would potable water.

It is thought that the fire fighting foam and method of the present invention and many of its attendant advantages will be understood from the foregoing descriptions and it will be apparent that various changes or modifications may be made to the examples presented without departing from the spirit and scope of the invention or sacrificing all of its material advantages, the form described herein being merely a preferred or exemplary embodiment of the invention.

I claim:

1. A method of producing a fire fighting foam for extinguishing fires, which comprises the step of producing a fire fighting foam concentrate solution comprising:

(i) a $C_1$–$C_4$ linear alcohol as a suspending solvent;

(ii) lauric alcohol as a foam stabilizing agent;

(iii) an acrylic acid polymer having a molecular weight in the range from 1,250,000 and 2,5000,000;

(iv) a primary foam producing agent selected from the group consisting of sodium lauryl sulfate and an alpha olefin sulfonate;

(v) coco-dimethylamidopropyl betaine as a secondary foam producing agent;

(vi) water as a dilutant;

(vii) urea as a fire retarding agent;

(viii) an alkaline pH-modifying substance to adjust the pH of the solution to the basic side of 7.0 selected from the group consisting of monoethanolamine, diethanolamine and triethanolamine; and (ix) a fire retarding agent selected from the group consisting of sodium bicarbonate, sodium carbonate, sodium acetate, and potassium acetate.

2. A method of producing a fire fighting foam for extinguishing fires, which comprises the step of producing a fire fighting foam concentrate solution as recited in claim 1 wherein, n-butyl alcohol is said suspending solvent.

3. A method of producing a fire fighting foam for extinguishing fires, which comprises the step of producing a fire fighting foam concentrate solution as recited in claim 1 wherein, n-propyl alcohol is the suspending solvent.

4. A method of producing a fire fighting foam for extinguishing fires, which comprises the step of producing a fire fighting foam concentrate solution as recited in claim 1 wherein, said alkaline pH-modifying substance is triethanolamine.

5. A method of producing a fire fighting foam for extinguishing fires, which comprises the step of producing a fire fighting foam concentrate solution as recited in claim 1 wherein, said alkaline pH-modifying substance is diethanolamine.

6. A method of producing a fire fighting foam for extinguishing fires, which comprises the step of producing a fire fighting foam concentrate solution as recited in claim 1 wherein, said alkaline pH-modifying substance is monoethanolamine.

7. A method of producing a fire fighting foam for extinguishing fires, which comprises the step of producing a fire fighting foam concentrate solution comprising:

(a) 2.10% of a $C_1$–$C_4$ linear alcohol;

(b) 0.42% of lauric alcohol;

(c) 0.42% of acrylic acid polymer having a molecular weight in the range from 1,250,000 to 2,500,000;

(d) 10.87% of a primary foam producing agent selected from the group consisting of a 23% solution of an alpha olefin sulfonate and water and a 23% solution of sodium lauryl sulfate and water;

(e) 21.68% of a 35% solution of coco-dimethylamidoproply betaine and water;

(f) 57.37% of water;

(g) 3.56% of granulated urea;

(h) an alkaline pH modifying substance in an amount sufficient to adjust the pH of the solution just to the base side of 7.0; and (i) 3.56% of a fire retarding agent selected from the group consisting of sodium carbonate, sodium bicarbonate, sodium acetate and potassium acetate.

8. A method of producing a fire fighting foam for extinguishing fires, which comprises the step of producing a fire fighting foam concentrate solution as recited in claim 7 wherein, said alkaline pH-modifying substance is selected from the group consisting of monoethanolamine, diethanolamine and triethanolamine.

9. A method of producing a fire fighting foam for extinguishing fires, which comprises the step of producing a fire fighting foam concentrate solution comprising:

(a) adding 1.419 kg of a $C_1$–$C_4$ linear alcohol to a mixing vessel as a suspending solvent, (b) continuously mixing the suspending solvent throughout the process of producing said concentrate solution with an impeller style mixer;

(c) adding 0.285 kg of lauric alcohol to said linear alcohol until all of said lauric alcohol is in solution;

(d) slowly adding 0.285 kg of acrylic acid polymer having a molecular weight in the range from 1,250,000 to 2,500,000 to the alcohol solution by sifting said acrylic acid polymer through a sifting device into the vortex of the alcohol solution created by said mixer at a rate sufficient to allow said acrylic acid polymer to go into homogeneous solution as it is added to said alcohol mixture;

(e) adding 7.335 kg of foam producing agent selected from the group consisting of: (1), a 23% solution of sodium lauryl sulfate and water, and (2), a 23% solution of an alpha olefin sulfonate and water, to said mixture, then mixing until all components of said mixture are into solution;

(f) adding 14.625 kg of a 35% solution of coco-dimethylamidopropyl betaine and water to said mixture and mixing said mixture until all of the components are in solution;

(g) adding 38.697 kg of water to said mixture and mixing said mixture until said mixture is homogeneous with all of the components are in solution;

(h) adding 2.400 kg of granulated urea to the mixing vessel and mixing said mixture until said mixture is again homogeneous and said urea is completely into solution;

(i) After said mixture has become homogeneous, adding a pH modifer selected from the group consisting of monoethanolamine, diethanolamine and triethanolamine to said mixture in an amount sufficient to adjust the pH of said mixture just to the base side of 7.0; and (j) adding 2.400 kg of a fire retarding agent selected from the group consisting of sodium carbonate, sodium bicarbonate, sodium acetate, and potassium acetate to said mixture and mixing said mixture until all of said fire retarding agent is in solution.

10. A method of producing a fire fighting foam for extinguishing fires, which comprises the step of producing a fire fighting foam concentrate solution as recited in claim 9 wherein, said mixer impeller is a three-bladed, marine style, mixer impeller turning at a rate from 800 rpm to 1200 rpm.

11. A method of producing a fire fighting foam for extinguishing fires, which comprises the step of producing a fire fighting foam concentrate solution as recited in claim 9 wherein, said sifting device is a coarse sieve.

12. A method of producing a fire fighting foam for extinguishing fires, which comprises the step of producing a fire fighting foam concentrate solution as recited in claim 9 wherein, said $C_1$–$C_4$ linear alcohol is n-butyl alcohol.

13. A method of producing a fire fighting foam for extinguishing fires, which comprises the step of producing a fire fighting foam concentrate solution as recited in claim 9 wherein, said $C_1$–$C_4$ linear alcohol is n-propyl alcohol.

14. A method of producing a fire fighting foam for extinguishing fires, which comprises the step of producing a fire fighting foam concentrate solution as recited in claim 9 wherein, said acrylic acid polymer is a homopolymer of acrylic acid having a molecular weight of about 1,250,000.

15. A method of producing a fire fighting foam for extinguishing fires, which comprises the step of producing a fire fighting foam concentrate solution as recited in claim 9, further comprising the additional step of introducing said foam concentrate solution to a stream of water through a siphoning nozzle.

16. A method of producing a fire fighting foam for extinguishing fires, which comprises the step of producing a fire fighting foam concentrate solution as recited in claim 15, wherein said stream of water from said siphoning nozzle flows at rate from 95 gallons per minute to 125 gallons per minute.

17. A method of producing a fire fighting foam for extinguishing fires, which comprises the step of producing a fire fighting foam concentrate solution comprising:

(a) 2.1% to 3.0% of a $C_1$–$C_4$ linear alcohol;

(b) 0.4% to 0.6% of lauric alcohol;

(c) 0.4% to 0.6% of a polymer of acrylic acid having a molecular weight in the range from 1,250,000 to 2,500,000;

(d) About 10.9% of foam producing agent selected from the group consisting of: (1), a 23% solution of sodium lauryl sulfate and water, and (2), a 23% solution of an alpha olefin sulfonate and water;

(e) 10.9% to 21.9% of a 35% solution of coco-dimethylamidopropyl betaine and water;

(f) About 57.4% of water;

(g) 0.6% to 4.5% of granulated urea;

(h) an alkaline pH-modifying substance in an amount sufficient to adjust the pH of the solution just to the base side of 7.0; and (i) 0.6% to 4.5% of a fire retarding agent selected from the group consisting of sodium carbonate, sodium bicarbonate, sodium acetate, and potassium acetate.

18. A method of producing a fire fighting foam for extinguishing fires, which comprises the step of producing a fire fighting foam concentrate solution as recited in claim 17, wherein said $C_1$–$C_4$ linear alcohol is n-propyl alcohol.

19. A method of producing a fire fighting foam for extinguishing fires, which comprises the step of producing a fire fighting foam concentrate solution as recited in claim 17, wherein said $C_1$–$C_4$ linear alcohol is n-butyl alcohol.

20. A method of producing a fire fighting foam for extinguishing fires, which comprises the step of producing a fire fighting foam concentrate solution as recited in claim 18, wherein said acrylic acid polymer is a homopolymer of acrylic acid having a molecular weight of about 1,250,000.

21. A method of producing a fire fighting foam for extinguishing fires, which comprises the step of producing a fire fighting foam concentrate solution as recited in claim 19, wherein said acrylic acid polymer is a homopolymer of acrylic acid having a molecular weight of about 1,250,000.

22. A method of producing a fire fighting foam for extinguishing fires, which comprises the step of producing a fire fighting foam concentrate solution as recited in claim 20, wherein said alkaline pH-modifying substance is selected from the group consisting of monoethanolamine, diethanolamine, and triethanolamine.

23. A method of producing a fire fighting foam for extinguishing fires, which comprises the step of producing a fire fighting foam concentrate solution as recited in claim 21, wherein said alkaline pH-modifying substance is selected from the group consisting of monoethanolamine, diethanolamine, and triethanolamine.

24. A method of producing a fire fighting foam for extinguishing fires, which comprises the step of producing a fire fighting foam concentrate solution as recited in claim 18, wherein said polymer of acrylic acid is a copolymer of acrylic acid having a molecular weight in the range from 1,250,000 to 2,500,000.

25. A method of producing a fire fighting foam for extinguishing fires, which comprises the step of producing a fire fighting foam concentrate solution as recited in claim 19 wherein said polymer of acrylic acid is a copolymer of acrylic acid having a molecular weight in the range from 1,250,000 to 2,500,000.

26. A method of producing a fire fighting foam for extinguishing fires, which comprises the step of producing a fire fighting foam concentrate solution as recited in claim 24, wherein said alkaline pH-modifying substance is selected from the group consisting of monoethanolamine, diethanolamine, and triethanolamine.

27. A method of producing a fire fighting foam for extinguishing fires, which comprises the step of producing a fire fighting foam concentrate solution as recited in claim 25, wherein said alkaline pH-modifying substance is selected from the group consisting of monoethanolamine, diethanolamine, and triethanolamine.

28. A method of producing a fire fighting foam extinguishing fires, which comprises the step of producing a fire fighting foam concentrate solution as recited in claim 26, further comprising the additional step of introducing said foam concentrate solution to a stream of water through a siphoning nozzle.

29. A method of producing a fire fighting foam extinguishing fires, which comprises the step of producing a fire fighting foam concentrate solution as recited in claim 27, further comprising the additional step of introducing said foam concentrate solution to a stream of water through a siphoning nozzle.

30. A method of producing a fire fighting foam for extinguishing fires, which comprises the step of producing a fire fighting foam concentrate solution as recited in claim 28, wherein said stream of water from said siphoning nozzle flows at rate from 95 gallons per minute to 125 gallons per minute.

31. A method of producing a fire fighting foam for extinguishing fires, which comprises the step of producing a fire fighting foam concentrate solution as recited in claim 29, wherein said stream of water from said siphoning nozzle flows at rate from 95 gallons per minute to 125 gallons per minute.

32. A method of producing a fire fighting foam for extinguishing fires, which comprises the step of producing a fire fighting foam concentrate solution comprising:

(a) adding between 2.1% and 3% of a $C_1$–$C_4$ linear alcohol to a mixing vessel as a suspending solvent.

(b) continuously mixing the suspending solvent through out the process of producing said concentrate solution with an impeller style mixer, said mixing to produce a vortex in said suspending solvent;

(c) adding between 0.4% and 0.6% of lauric alcohol to said linear alcohol until all of said lauric alcohol is a mixture in solution with said suspending solvent;

(d) slowly adding between 2.1% and 3.0% of acrylic acid polymer having a molecular weight in the range from 1,250,000.00 to 2,500,000 to the alcohol solution by sifting said acrylic acid polymer through a sifting device into said vortex of said suspending solvent at a rate sufficient to allow said acrylic acid polymer to go into homogeneous solution as it is added to said alcohol mixture;

(e) adding about 10.9% of a 23% solution of sodium lauryl sulfate and water to said mixture and mixing until all components of said mixture are in solution;

(f) adding between 10.9% and 21.9% of a 35% solution of coco-dimethylamidoproply betaine and water to said mixture and mixing said mixture until all of the components are in solution;

(g) adding about 57.4% of water to said mixture and mixing said mixture until said mixture is homogeneous with all of the components are in solution;

(h) adding between 0.6% and 4.5% of granulated urea to the mixing vessel and mixing said mixture until said mixture is again homogeneous and said urea is completely in solution with said mixture;

(i) After said mixture has become homogeneous, adding triethanolamine (99%) to said mixture in an amount sufficient to adjust the pH of said mixture just to the base side of 7.0; and (j) adding between 0.6% and 4.5% of granulated sodium bicarbonate (anhydrous, 99%) to said mixture and mixing said mixture until all of said sodium bicarbonate is in solution with said mixture.

33. A method of producing a fire fighting foam for extinguishing fires, which comprises the step of producing a fire fighting foam concentrate solution as recited in claim 32, further comprising the additional step of introducing said foam concentrate solution to a stream of water through a siphoning nozzle.

34. A method of producing a fire fighting foam for extinguishing fires, which comprises the step of producing a fire fighting foam concentrate solution as recited in claim 32, wherein said stream of water from said siphoning nozzle flows at rate from 95 gallons per minute to 125 gallons per minute.

35. A fire fighting foam concentrate solution for producing a foam to extinguish fires by introducing the concentrate solution through a siphoning nozzle to a stream of water produced by the siphoning nozzle comprising:

(a) 2.1% to 3.0% of a $C_1$–$C_4$ linear alcohol;

(b) 0.4% to 0.6% of lauric alcohol;

(c) 0.4% to 0.6% of an acrylic acid polymer having a molecular weight in the range from 1,250,000 to 2,500,000;

(d) About 10.9% of a foam producing agent selected from the group consisting of: (1), a 23% solution of sodium lauryl sulfate and water, and (2), a 23% solution of an alpha olefin sulfonate and water;

(e) 10.9% of 21.9% of a 35% solution of coco-dimethylamidopropyl betaine and water;

(f) About 57.4% of water;

(g) 0.6% of 4.5% of granulated urea;

(h) an alkaline pH-modifying substance in an amount sufficient to adjust the pH of the solution just to the base side of 7.0; and (i) 0.6% to 45% of a fire retarding agent selected from the group consisting of granulated sodium bicarbonate and granulated sodium carbonate (anhydrous 99%).

36. A fire fighting foam concentrate solution for producing a foam to extinguish fires by introducing the concentrate solution through a siphoning nozzle to a stream of water produced by the siphoning nozzle as recited in claim 35 wherein, said $C_1$–$C_4$ linear alcohol is n-propyl alcohol.

37. A fire fighting foam concentrate solution for producing a foam to extinguish fires by introducing the concentrate solution through a siphoning nozzle to a stream of water produced by the siphoning nozzle as recited in claim 35 wherein, said $C_1$–$C_4$ linear alcohol is n-butyl alcohol.

38. A fire fighting foam concentrate solution for producing a foam to extinguish fires by introducing the concentrate solution through a siphoning nozzle to a stream of water produced by the siphoning nozzle as recited in claim 35 wherein, said acrylic acid polymer is a homopolymer of acrylic acid having a molecular weight of about 1,250,00.

39. A fire fighting foam concentrate solution for producing a foam to extinguish fires by introducing the concentrate solution through a siphoning nozzle to a stream of water produced by the siphoning nozzle as recited in claim 35 wherein, said alkaline ph-modifying substance is selected from a group containing monoethanolamine (99%), diethanolamine (99%), and triethanolamine (99%).

40. A fire fighting foam concentrate solution for producing a foam to extinguish fires by introducing the concentrate solution through a siphoning nozzle to a stream of water produced by the siphoning nozzle as recited in claim 35 wherein, wherein said stream of water from said siphoning nozzle flows at rate from 95 gallons per minute to 125 gallons per minute.

* * * * *